United States Patent [19]

Matsudaira et al.

[11] Patent Number: 4,870,322

[45] Date of Patent: Sep. 26, 1989

[54] ELECTROLUMINESCENT PANEL HAVING A LAYER OF GERMANIUM NITRIDE BETWEEN AN ELECTROLUMINESCENT LAYER AND A BACK ELECTRODE

[75] Inventors: Takeo Matsudaira; Yasumoto Shimizu, both of Tokyo, Japan

[73] Assignee: Hoya Corporation, Tokyo, Japan

[21] Appl. No.: 852,296

[22] Filed: Apr. 15, 1986

[51] Int. Cl.[4] ..... H05B 33/02

[52] U.S. Cl. ..... 313/506; 313/509

[58] Field of Search ..... 313/506, 509, 505; 357/2

[56] References Cited

U.S. PATENT DOCUMENTS

| | | | |
|---|---|---|---|
| 4,188,565 | 2/1980 | Mizukami et al. | 313/509 |
| 4,287,449 | 9/1981 | Takeda et al. | 313/509 |
| 4,455,509 | 6/1984 | Ayyagori et al. | 313/506 |
| 4,492,281 | 1/1985 | Ovshinsky et al. | 357/2 |
| 4,532,454 | 7/1985 | Abdalla | 313/506 |

*Primary Examiner*—David K. Moore

*Assistant Examiner*—Sandra L. O'Shea

*Attorney, Agent, or Firm*—Roberts, Spiecens & Cohen

[57] ABSTRACT

In an electroluminescent panel comprising a transparent electrode, a back electrode, and an electroluminescent layer between the transparent and the back electrodes, an intermediate layer is interposed between the electroluminescent layer and the back electrode and essentially consists of germanium and nitrogen. The intermediate layer serves as a light absorption layer for absorbing ambient light. A nitrogen distribution in the intermediate layer may be either substantially uniform or decreased from the electroluminescent layer side towards the back electrode side. The decrease may be made stepwise or continuously. The intermediate layer may be superposed through a dielectric layer or directly on the electroluminescent layer. Only oxygen may be added in intermediate layer to the germanium and the nitrogen, to provide either a substantially uniform oxygen distribution or a variable oxygen distribution which is continuously or stepwise decreased from the electroluminescent layer side towards the back electrode side.

51 Claims, 6 Drawing Sheets

ELECTROLUMINESCENT PANEL HAVING A LAYER OF GERMANIUM NITRIDE BETWEEN AN ELECTROLUMINESCENT LAYER AND A BACK ELECTRODE

BACKGROUND OF THE INVENTION (a) Field of the Invention

This invention relates to an electroluminescent panel for use in an input/output device of a computer or the like to display an image, such as alphanumeric symbols, a static picture, a motion picture, and the like.

(b) Description of Prior Art

As a rule, an electroluminescent panel of the type described comprises a transparent substrate, a transparent or front electrode on the substrate, a back electrode opposite the transparent electrode, and an electroluminescent layer between the front and back electrodes.

As will later be described with reference to a few figures of the accompanying drawing, an electroluminescent panel is proposed by John M Lo in GB 2,039,146A and comprises a light absorption layer between the electroluminescent layer and the back electrode. According to Lo, the light absorption layer must preferably have a resistivity between $10^2$ Ω·cm and $10^5$ Ω·cm so as to improve contrast and brightness. To this end, Lo's attention is mainly directed to telluride materials, such as cadmium telluride (CdTe), zinc telluride (ZnTe), lead telluride (PbTe), and tin telluride (SnTe).

However, it has been found that a desired brightness can be accomplished only by supply of a comparatively high electric voltage between the front and back electrodes because the brightness slowly or gently increases with an increase of the electric voltage. Such supply of a high electric voltage might give rise to dielectric breakdown in the electroluminescent panel.

In Japanese Unexamined Patent Publication No. Sy ô 59-154,793, namely, 154,793/1984, an improved electroluminescent panel is disclosed which comprises amorphous semiconductor layers between the front electrode and the electroluminescent layer and between the electroluminescent layer and the back electrode. Each amorphous semiconductor layer is of silicon or silicon carbide (SiC) and has therefore a comparatively high resistivity, as known in the art. Thus, each amorphous layer has a high resistivity.

According to the inventor's experimental studies, intervention of such a high resistivity layer results in an increase of the electric voltage supplied between the front and back electrodes.

In U.S. patent application Ser. No. 728,595 assigned to the instant assignee, S. Kawai discloses another electroluminescent panel comprising a light absorption layer of a lower-order oxide of germanium. With this electroluminescent panel, it is possible to accomplish a desired brightness by supply of a comparatively low electric voltage.

However, the lower-order oxide of germanium is poor in chemical proof and is susceptible to aging in an electric field resulting from supply of the electric voltage. Accordingly, the electroluminescent panel is low in yield on fabrication thereof and has a short life in practical use.

SUMMARY OF THE INVENTION

It is an object of this invention to provide an electroluminescent panel which has a long life in practical use.

It is another object of this invention to provide an electroluminescent panel of the type described, which can be fabricated with a high yield.

It is still another object of this invention to provide an electroluminescent panel of the type described, which accomplishes a desired brightness by supply of a low electric voltage.

An electroluminescent panel to which this invention is applicable comprises a transparent electrode, a back electrode opposite to the transparent electrode, and an electroluminescent layer for emitting electroluminescent light between the transparent and the back electrodes. According to this invention, the electroluminescent panel further comprises an intermediate layer between the electroluminescent layer and the back electrode. The intermediate layer essentially consists either of germanium and nitrogen or of germanium, nitrogen, and oxygen.

DESCRIPTION OF THE PREFERRED EMBODIMENTS

Figure 1:
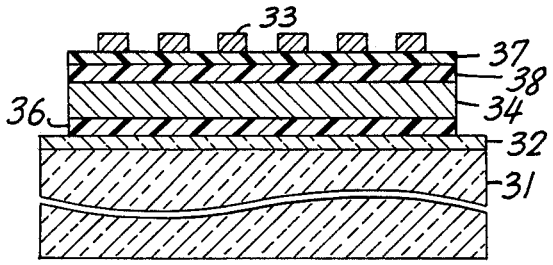
FIG. 1 PRIOR ART
FIG. 1 is a sectional view of a conventional electroluminescent panel.

Referring to FIG. 1, a conventional electroluminescent panel will be described at first for a better understanding of this invention and is substantially equivalent to that described in GB 2,039,146A referred to in the Description of Prior Art in the instant specification. The illustrated electroluminescent panel comprises a transparent substrate 31 of glass. A transparent electrode 32 is deposited on the substrate 31. The illustrated transparent electrode 32 comprises ndium oxide ($In_2O_3$), tin oxide ($SnO_2$), or the like and is divided into a plurality of parallel transparent conductors extended from the lefthand side of FIG. 1 to the righthand one.

A back electrode 33 is opposite the transparent electrode 32 and also divided into a plurality of back conductors of, for example, aluminum. The back conductors intersect the transparent conductors at cross points corresponding to picture elements of the electroluminescent panel and are substantially orthogonal to the transparent conductors.

An electroluminescent layer 34 is interposed between the transparent and the back electrodes 32 and 33. The illustrated electroluminescent layer 34 comprises zinc sulfide (ZnS) doped with manganese (Mn). The zinc sulfide (ZnS) and the manganese (Mn) serves as a base material and an activator, respectively, on emission of electroluminescent light from the electroluminescent layer 34.

Alternatively, the base material may be zinc selenide (ZnSe) while the activator may be selected from a group consisting of terbium (Tb), samarium (Sm), copper (Cu), aluminum (Al), and bromine (Br). The activator is usually added to the base material by 0.1–2.0% by weight.

A front dielectric layer 36 is laid between the transparent electrode 32 and the electroluminescent layer 34 while a back dielectric layer 37 is interposed between the electroluminescent layer 34 and the back electrode 33. Each of the front and the back dielectric layers 36 and 37 may be of yttrium oxide ($Y_2O_3$), silicon nitride ($Si_3N_4$), tantalum pentoxide ($Ta_2O_5$), or the like.

A light absorbing layer 38 is inserted between the electroluminescent and the back dielectric layers 34 and 37. The light absorbing layer 38 may be of a telluride material, such as cadmium telluride (CdTe), zinc telluride (ZnTe), lead telluride (PbTe), tin telluride (SnTe), or the like.

With this structure, the electroluminescent layer 34 emits electroluminescent light of a yellowish orange color at the cross points of the transparent and the back conductors by application of an a.c. voltage in a known manner. More particularly, electrons are excited from a ground state to a conduction band by an electric field resulting from application of the a.c. voltage and are accelerated to stimulate luminescent centers formed in the activator. Such stimulated luminescent centers give off the electroluminescent light when they return back to the ground state. The electroluminescent light is directed towards the transparent electrode 32 and the substrate 31 to display a visible image. In this event, the light absorbing layer 38 absorbs ambient light. Anyway, the light absorbing layer 38 serves to improve the contrast and performance of the panel.

In order to achieve a high contrast, the resistivity of the light absorbing layer is selected between $10^2$ Ω·cm and $10^5$ Ω·cm, as described in the Description of the Prior Art in the instant specification.

Figure 2:
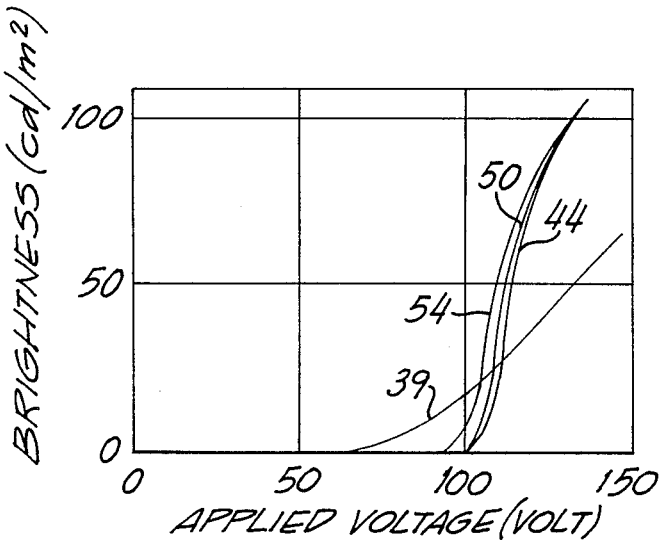
FIG. 2 is a graphical representation for use in describing various brightness versus applied voltage characteristics of electroluminescent panels illustrated in FIGS. 1, 3, 6, and 7.

Temporarily referring to FIG. 2, the electroluminescent panel has a brightness versus applied voltage characteristic as exemplified by a curve 39. As is apparent from the curve 39, the brightness slowly or gently increases with an increase of the voltage supplied between the transparent and back electrodes. This means that a high voltage should be supplied between the transparent and the back electrodes so as to obtain a desired brightness. Supply of such a high voltage may bring about dielectric break down of the electroluminescent layer 34 and the like.

Referring back to FIG. 1, the electroluminescent panel illustrated in FIG. 1 is susceptible to peeling between the electroluminescent layer 34 and the back dielectric layer 37 even when the light absorbing layer 38 is superposed on the electroluminescent layer 34. In addition, cracks often take place in the back dielectric layer 37. This is because the light absorbing layer 38 comprising cadmium telluride (CdTe) is readily soluble in the etching solvent which is used in forming the back electrode 33 of aluminum by etching.

Alternatively, the light absorbing layer may comprise either vanadium trioxide ($V_2O_3$) or boron carbide ($B_4C$), instead of the telluride material as mentioned above and gives a brightness versus applied voltage characteristic an in the curve 39. As a result, a desired brightness can not be obtained by supply of a low voltage lower than 150 volts.

In order to rapidly or steeply increase the brightness versus applied voltage characteristic, it may be considered that the light absorbing layer and the back dielectric layer are upset relative to each other. In this event, the back dielectric layer is superposed on the electroluminescent layer with the light absorbing layer overlaid on the back dielectric layer. However, the light absorbing layer of vanadium trioxide ($V_2O_3$) or boron carbide ($B_4C$) does not act as an effective light absorbing one and has a comparatively low resistivity. In order to increase light absorptivity, the light absorbing layer should inevitably become thick. However, such a thick light absorbing layer gives rise to objectionable crosstalk such that an undesired picture element is luminous at an undesired position adjacent to a desired position.

Figure 3:
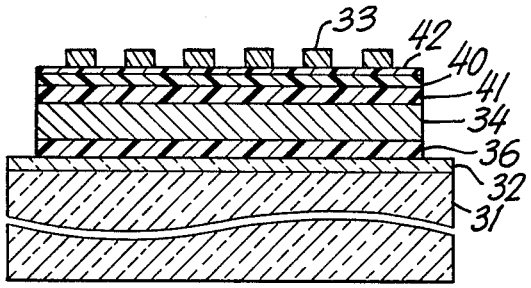
FIG. 3 is a sectional view of an electroluminescent panel according to a first embodiment of this invention.

Referring to FIG. 3, an electroluminescent panel according to a first embodiment of this invention comprises similar parts designated by like reference numerals. The electroluminescent panel comprises an intermediate layer 40 interposed between the electroluminescent layer 34 and the back electrode 33. The intermediate layer 40 has a first surface directed towards the electroluminescent layer 34 and a second surface directed towards the back electrode 33. In FIG. 3, the first and second surfaces are directed downwards and upwards, respectively.

It is to be noted here that the intermediate layer 40 essentially consists of germanium and nitrogen and that the nitrogen is substantially uniformly dispersed or distributed into the germanium. A distribution of the nitrogen into the germanium may be called a nitrogen distribution. The illustrated intermediate layer 40 has a substantially uniform nitrogen distribution and acts as a light absorbing layer for absorbing ambient light.

The front dielectric layer 36 is placed between the transparent electrode 32 and the electroluminescent layer 34 as in the panel illustrated in FIG. 1. The back dielectric layer is mechanically separated in two layers 41, 42 with the intermediate layer 40 interposed therebetween namely between lower and upper back dielectric layers 41 and 42. The lower and upper back dielectric layers 41 and 42 will be called first and second dielectric layers, respectively. More specifically, the first dielectric layer 41 is placed between the electroluminescent and the intermediate layers 34 and 40 while the second dielectric layer 42 is interposed between the intermediate layer 40 and the back electrode 33. The illustrated first dielectric layer 41 is in contact with both the electroluminescent and the intermediate layers 34 and 40. The second dielectric layer 42 is in contact with both the intermediate layer 40 and the back electrode 33.

At any rate, the back dielectric layer which is divided into the first and second dielectric layers 41 and 42 is interposed between the electroluminescent layer 34 and the back electrode 33. In addition, the first and the second surfaces of the intermediate layer 40 are in contact with the first and the second dielectric layers 41 and 42, respectively.

The illustrated transparent substrate 31 may be of aluminosilicate glass, such as NA40 manufactured and sold by HOYA Corporation, Tokyo, Japan. The substrate 31 has a front surface directed downward in FIG. 3 and a back or principal surface which is opposite the front surface and on which the transparent electrode 32 is deposited.

As in FIG. 1, the transparent electrode 32 consists of indium oxide ($In_2O_3$) doped with tin oxide ($SnO_2$) and is divided into a plurality of transparent conductors. Each of the transparent conductors is electrically isolated from one another and is extended from the righthand side of FIG. 3 to the lefthand side thereof as in FIG. 1.

Likewise, the back electrode 33 consists of aluminum and is divided into a plurality of back conductors which are orthogonal to and isolated from the transparent conductors.

Each of the illustrated front, first, and second dielectric layers 36, 41, and 42 consists of tantalum pentoxide ($Ta_2O_5$).

In the example being illustrated, the electroluminescent layer 34 comprises zinc sulfide (ZnS) and the manganese (Mn).

The illustrated electroluminescent panel is manufactured in the following manner. At first, a transparent conductive layer is deposited on the principal or upper surface of the transparent substrate 31 by vacuum evaporation and is etched to form the transparent electrode 32 by the use of an etching solvent which comprises hydrochloric acid (HCl) and ferric chloride ($FeCl_3$). The transparent electrode 32 is 2000 angstroms thick.

On the transparent electrode 32 and the transparent substrate 31, the front dielectric layer 36 of $Ta_2O_5$ is deposited by reactive sputtering. The reactive sputtering is carried out in a sputtering device by the use of a target of metallic tantalum in an atmosphere of a mixed gas kept at a pressure of $6\times10^{-1}$ Pascal. The mixed gas may be an oxygen gas of 30% and an argon gas of 70%. In this event, the target is supplied with radio-frequency (RF) electric power of $9W/cm^2$. The front dielectric layer 36 is 3000 angstroms thick.

On the front dielectric layer 36, the electroluminescent layer 34 is deposited to a thickness of 6000 angstroms by vacuum evaporation or deposition. To this end, a sintered pellet is used which comprises zinc sulfide doped with 0.5% by weight of manganese. The sintered pellet may serve as an evaporation source.

Thereafter, the first dielectric layer 41 of $Ta_2O_5$ is deposited to a thickness of 3000 angstroms on the electroluminescent layer 34 by reactive sputtering like the front dielectric layer 36.

Subsequently, the intermediate layer 40 is deposited to a thickness of 1500 angstroms on the first dielectric layer 41 at a deposition rate of 120 angstroms/minute by reactive sputtering. The reactive sputtering is carried out in a sputtering device by the use of a target of germanium (Ge) in an atmosphere of a mixed gas kept at a pressure of $6\times10^{-1}$ Pascal. The mixed gas may be, for example, a nitrogen gas of 40% and an argon gas of 60%. In this event, the target is supplied with radio-frequency electric power of $6W/cm^2$.

It has been confirmed that the nitrogen distribution in the intermediate layer 40 is substantially uniform because the ratio of the nitrogen gas to the mixed gas in the atmosphere is kept constant during the reactive sputtering. The intermediate layer 40 has a resistivity of $10^5$ Ω·cm.

The second dielectric layer 42 of $Ta_2O_5$ is deposited to a thickness of 1000 angstroms on the intermediate layer 40 by reactive sputtering as was the front and the first dielectric layers 36 and 41.

On the second dielectric layer 42, an aluminum layer is overlaid by vacuum evaporation and is etched to form the back electrode 33 by the use of an etching solvent which comprises nitric acid ($HNO_3$) and phosphoric acid ($H_3PO_4$). The back electrode 33 is 3000 angstroms thick.

In practical use, an a.c. voltage is supplied between the transparent and the back electrodes 32 and 33. The a.c. voltage may have a frequency of 100 Hz. By supply of the a.c. voltage, the illustrated electroluminescent panel is luminous in yellowish orange color at a brightness of 100 $cd/m^2$ to emit electroluminescent light. The electroluminescent light is visible through the front dielectric layer 36, the transparent electrode 32, and the transparent substrate 31. The electroluminescent light has a peak wavelength of 580 nanometers.

Description is made about advantages of the electroluminescent panel according to the first embodiment of this invention. In the electroluminescent panel, the intermediate layer 40 substantially absorbs ambient light which is incident onto the transparent substrate 31 and which is directed towards the back electrode 33. Therefore, the ambient light scarcely reaches the back electrode 33. Even if the ambient light partially reaches the back electrode 33, such partial light is subjected to internal reflection by the back electrode 33 and sent towards the transparent substrate 31 as reflected or return light. The return light is also absorbed by the light absorbing layer 40 and scarcely appears through the transparent substrate 31.

Figure 4:
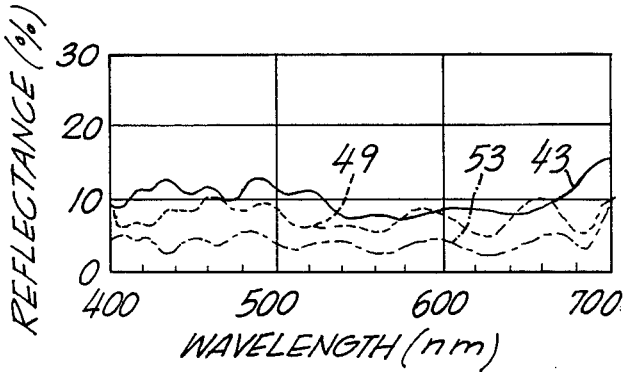
FIG. 4 is a graph for use in describing a reflectance of electroluminescent panels illustrated in FIGS. 3, 6, and 7.

Referring to FIG. 4, the electroluminescent panel illustrated in FIG. 3 exhibits a reflectance characteristic as exemplified by a curve 43. The reflectance is observed outside the front surface of the transparent substrate 31. The reflectance is defined as an intensity ratio of the return light observed on the outside of the front surface of the transparent substrate 31 to the ambient light incident onto the transparent substrate 31.

As seen from the curve 43, an average reflectance of the electroluminescent panel illustrated in FIG. 3 is approximately equal to 10% within a range between 400 nm and 700 nm. Therefore, the electroluminescent panel exhibits a high contrast.

Figure 5:
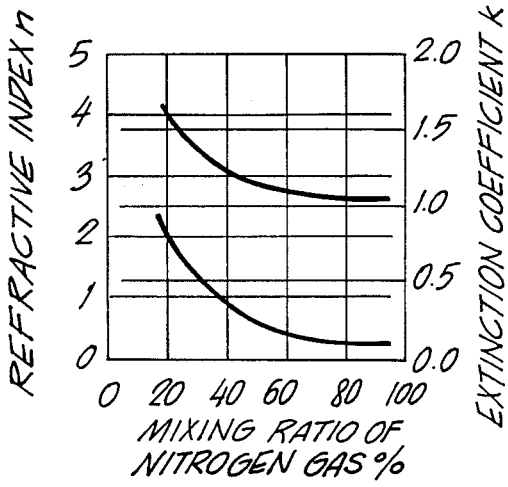
FIG. 5 is a graphical representation for use in describing a method of manufacturing intermediate layers of electroluminescent panels of this invention.

Referring to FIG. 5, description will be made about a relationship between optical constants of the intermediate layer (that is, the light absorbing layer) 40 and the mixing ratio of the nitrogen gas introduced into a vacuum chamber during deposition of the light absorbing layer 40. In the example being illustrated, a refractive index n and an extinction coefficient k are exemplified as the optical constants at a wavelength of 600 nm.

As readily understood from FIG. 5, the refractive index n and the extinction coefficient k are varied in dependency upon the mixing ratio of the nitrogen gas to the mixed gas introduced into the atmosphere. As readily seen, an increase of the mixing ratio of nitrogen gas results in an increment of an amount of nitrogen included in the light absorbing layer 40. The amount of nitrogen included in the light absorbing layer 40 is specified by the amount of nitrogen to germanium. As shown in FIG. 5, the refractive index n and the extinction coefficient k tend to be decreased with an increase of the mixing ratio of nitrogen, namely, an increment of the ratio of nitrogen to germanium. The refractive index n and the extinction coefficient k of the illustrated light absorbing layer 40 are equal to 3 and 0.3 for light of wavelength of 600 nm, respectively. On the other hand, the refractive index of the first dielectric layer 41 is equal to 2.2 for light of wavelength of 600 nm.

Let evaluation be made about the illustrated electroluminescent panel. In general, it is possible to evaluate such an electroluminescent panel by a reflectance characteristic. The reflectance characteristic is given by ambient light incident onto the transparent substrate 31 and reflected light internally returned back onto the transparent substrate 31. The reflected light may be referred to as return light. Specifically, the reflectance characteristic is defined by the ratio of return light to ambient light which may be called a reflection ratio.

To get a small reflection ratio, it is effective to minimize a reflectance in an interface between the first dielectric and the light absorbing layers 41 and 40. Such a reflectance between the first dielectric and the light absorbing layers 41 and 40 will be represented by $R_{41.40}$ and is calculated by:

$$R_{41.40}=[(n_{41}-n_{40})^2+k_{40}^2]/[(n_{41}+n_{40})^2+k_{40}^2], \quad (1)$$

where $n_{41}$ represents a refractive index of the first dielectric layer 41 and $n_{40}$ and $k_{40}$ represent a refractive index and an extinction coefficient of the light absorbing layer 40, respectively. In the illustrated example, the refractive indices $n_{40}$ and $n_{41}$ and the extinction coefficient $k_{40}$ are given by:

$$n_{40}=3,\ k_{40}=0.3,\ n_{41}=2.2. \quad (1')$$

Substitution of Equations (1') into Equation (1) gives:

$$R_{41.40}\approx 2.7(\%).$$

Inasmuch as the first dielectric layer 41 of tantalum pentoxide ($Ta_2O_5$), hafnium oxide ($HfO_2$), silicon nitride ($Si_3N_4$), yttrium oxide ($Y_2O_3$), or the like has a refractive index which is equal to about 2, it is desirable that an average refractive index $\bar{n}$ and an average extinction coefficient $\bar{k}$ of the light absorbing layer 40 are not greater than 4 and 1, respectively, in order to decrease reflection in the interface between the first dielectric layer 41 and the light absorbing layer 40. The optical constants of the light absorbing layer 40 are selected so that the electroluminescent panel has an excellent reflectance characteristic by controlling the above-mentioned mixing ratio of nitrogen gas to the mixed gas and deposition rate of the light absorbing layer 40.

Referring back to FIG. 2, a curve 44 shows brightness versus applied voltage characteristic of the electroluminescent panel illustrated in FIG. 3. As seen from the curve 44, the brightness is steeply increased with an increase of the applied voltage between the transparent and the back electrodes and exceeds 100 cd/m$^2$ at the applied voltage lower than 150 volts. It is possible to lower the applied voltage and to therefore prevent occurrence of the dielectric breakdown.

In FIG. 3, the electroluminescent panel is advantageous in the following respects.

In general, the crosstalk can be avoided if a resistivity of a light absorbing layer is not smaller than $10^3$ Ω·cm under the condition that the light absorbing layer is thick enough to obtain a desired light absorptivity, namely, the thickness is not smaller than several hundred angstroms.

As mentioned before, the thickness and the resistivity of the light absorbing layer 40 are equal to 1500 angstroms and $10^5$ Ω·cm, respectively. Accordingly, the crosstalk can favorably be eliminated in the electroluminescent panel.

In addition, the light absorbing layer 40 is never etched by the etching solvent, namely, etchant of nitric acid which is for use in forming the back electrode 33. This is because the light absorbing layer 40 underlies the second dielectric layer 42 which withstands the etchant of nitric acid. The second dielectric layer is also effective to prevent occurrence of the dielectric breakdown.

According to the inventor's experiments, it has been found out that similar brightness versus applied voltage and contrast characteristics can be accomplished even when the thickness of the first dielectric layer 41 is reduced to 1000 angstroms and/or the thickness of the second dielectric layer 42 is increased up to 3000 angstroms.

A semiconductor layer of, for example, silicon (Si), silicon carbide (SiC), or the like may be substituted for the second dielectric layer 42. In this event, it is preferable that the semiconductor layer has a resistivity which is not smaller than $10^3$ Ω·cm so as to avoid the crosstalk.

The light absorbing layer 40 is formed by the sputtering method. Use of the sputtering makes the light absorbing layer 40 dense in microstructure and stable against aging.

Figure 6:
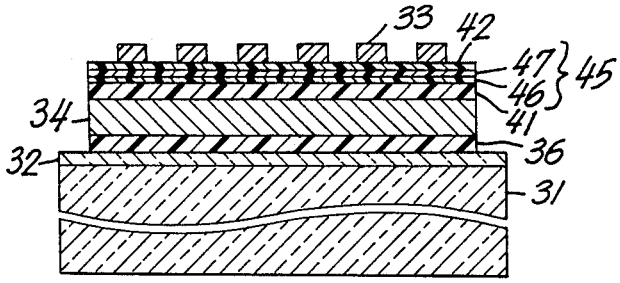
FIG. 6 is a sectional view of an electroluminescent panel according to a second embodiment of this invention.

Referring to FIG. 6, an electroluminescent panel according to a second embodiment of this invention is similar to that illustrated in FIG. 3 except that the electroluminescent panel comprises an intermediate layer 45 divided into first and second films 46 and 47. The first and the second films 46 and 47 provide the first and the second surfaces directed towards the electroluminescent layer 34 and the back electrode 33, respectively. As shown in FIG. 6, the first film 46 is brought into contact with the second film 47 on one side thereof and with the first dielectric layer 41 on the other side, namely, the first surface. The second film 47 is attached to the second dielectric layer 42 on the second surface.

The first and the second films 46 and 47 consist of germanium and nitrogen and are specified by first and second nitrogen distributions, respectively. Each of the first and the second nitrogen distributions is substantially uniform. The first and the second nitrogen distributions are defined by first and second ratios of nitrogen to germanium, respectively. In the example being illustrated, the second ratio is less than the first amount ratio. Both the first and the second films 46 and 47 which may collectively be called the intermediate layer 45 also serve as a light absorbing layer for absorbing ambient light which is incident onto the transparent substrate 31 and which is directed towards the back electrode 33, like the intermediate layer 40 illustrated in FIG. 3.

The intermediate layer 45 is manufactured in the following manner. At first, the first film 46 is deposited on the first dielectric layer 41 at a deposition rate of 110 angstroms/minute by reactive sputtering. The reactive sputtering is carried out in a sputtering device by the use of a target of germanium (Ge) in an atmosphere of a mixed gas kept at a pressure of $6\times10^{1}$ Pascal. The mixed gas is mixed at a ratio of 50% of nitrogen gas and 50% of argon gas. In this event, the target is supplied with radio-frequency electric power of $6W/cm^2$. The sputtering lasts until the first film 46 is deposited to a thickness of 300 angstroms. As a result, the first nitrogen distribution of the first film 46 becomes substantially uniform. This is because the ratio of the nitrogen gas to the mixed gas in the atmosphere is kept constant during the sputtering. The first film 46 has a resistivity of $10^6$ Ω·cm and the first ratio dependent on the mixed gas.

Subsequently, the second film 47 is deposited on the first film 46 to a thickness of 1000 angstroms at a deposition rate of 125 angstroms/minute by reactive sputtering. The reactive sputtering is carried out in the sputtering device by the use of the target of germanium in an atmosphere of that mixed gas kept at a pressure of $6\times10^{-1}$ Pascal which consists of 30% of nitrogen gas and 70% of argon gas. In this event, the target is supplied with a radio-frequency electric power of $6W/cm^2$. The second nitrogen distribution of the second film 47 thus manufactured is substantially uniform as in the first film 46. The second film 47 has a resistivity of $10^5$ Ω·cm and the second ratio which is dependent on the mixed gas and which is less than the first ratio of the first film 46. This is because the ratio of the nitrogen gas to the mixed gas in the atmosphere for the second film 47 is less than that for the first film 46.

From this fact, it is readily understood that the nitrogen distribution is stepwise varied in the intermediate layer 45. More particularly, the nitrogen distribution is stepwise decreased from the first surface to the second surface. On the second surface of the second film 47, the second dielectric layer 42 is formed as in the panel illustrated in FIG. 3.

The illustrated electroluminescent panel is luminous in yellowish orange color at a brightness of 100 $cd/m^2$ to emit electroluminescent light when the a.c. voltage of a sinusoidal wave of 100 Hz is supplied to the electroluminescent panel. The electroluminescent light has a peak wavelength of 580 nanometers.

Description is made regarding advantages of the electroluminescent panel according to the second embodiment of this invention.

As shown in FIG. 5, the first film 46 has a refractive index $n_{46}$ equal to 2.9 and an extinction coefficient $k_{46}$ equal to 0.2 while the second film 47 has a refractive index $n_{47}$ equal to 3.5 and an extinction coefficient $k_{47}$ equal to 0.6. The first dielectric layer 41 has a refractive index $n_{41}$ equal to 2.2 as in the panel illustrated in FIG. 3.

Let a reflectance $R_{41.46}$ be defined in an interface between the first dielectric layer 41 and the first film 46. The reflectance $R_{41.46}$ is calculated by:

$$R_{41.46}=[(n_{41}-n_{46})^2+k_{46}^2]/[(n_{41}+n_{46})^2+k_{46}^2]. \quad (2)$$

When the refractive indices $n_{41}$ and $n_{46}$ and the extinction coefficient $k_{46}$ are equal to 2.2, 2.9, and 0.2, respectively, the reflectance $R_{41.46}$ approximately becomes 2.0%. In addition, let a reflectance $R_{46.47}$ be also defined in an interface between the first and the second films 46 and 47. The reflectance $R_{46.47}$ is calculated by:

$$R_{46.47}=[(n_{46}-n_{47})^2+k_{47}^2]/[(n_{46}+n_{47})^2+k_{47}^2]. \quad (3)$$

Likewise, the reflectance $R_{46.47}$ becomes approximately 1.7%.

Thus, both reflectances $R_{41.46}$ and $R_{46.47}$ are considerably low. In addition, the intermediate layer 45 exhibits an extinction coefficient distribution stepwise and increasingly varies from the first surface to the second surface because the extinction coefficient $k_{47}$ is larger than the extinction coefficient $k_{46}$. The intermediate or light absorbing layer 45 can therefore effectively absorb the ambient light even when the intermediate layer 45 is thinner than the intermediate layer 40 as shown in FIG. 3. As a result, the electroluminescent panel illustrated in FIG. 6 exhibits a low reflectance characteristic as exemplified by curve 49 in FIG. 4. The reflectance is also measured on an outside of the front surface of the transparent substrate 31. An average reflectance can be restricted to a low range between 7% and 8% within a visible range between 400 nm and 700 nm. Thus, it is also possible to provide a high contrast electroluminescent panel.

The electroluminescent panel illustrated in FIG. 6 has a brightness versus applied voltage characteristic as exemplified by a curve 50 in FIG. 2. As is apparent from the curve 50, the brightness is steeply increased with an increase of applied voltage between the transparent and the back electrodes 32 and 33 as in the panel illustrated in FIG. 3. It is possible to achieve the brightness of 100 $cd/m^2$ even when the applied voltage is lower than 150 volts. This means that the dielectric breakdown can be prevented by the electroluminescent panel illustrated in FIG. 6. In addition, the first and the second films 46 and 47 have comparatively small thickness of 300 angstroms and 1000 angstroms which can effectively absorb the light, respectively, and resistivities of $10^6$Ω·cm and $10^5$Ω·cm, respectively, higher than $10^3$Ω·cm. The cross-talk can therefore be avoided, as described in conjunction with FIG. 3.

Figure 7:
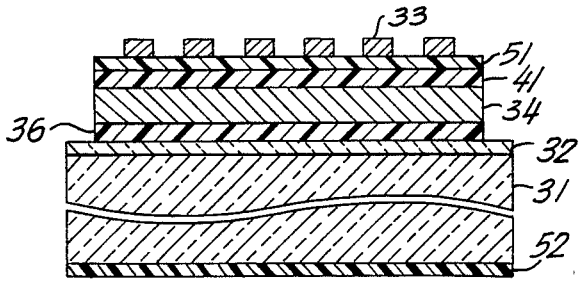
FIG. 7 is a sectional view of an electroluminescent panel according to a third embodiment of this invention.

Referring to FIG. 7, an electroluminescent panel according to a third embodiment of this invention comprises similar parts designated by like reference numerals. The electroluminescent panel comprises an intermediate layer 51 interposed between a back electrode 33 and a back dielectric layer 41 which corresponds to the first dielectric layer 41 illustrated in FIG. 3. Thus, the intermediate layer 51 has first and second surfaces which are directed towards the electroluminescent layer 34 and the back electrode 33, respectively, and which are brought into contact with the back dielectric layer 41 and the back electrode 33, respectively.

The intermediate layer 51 consists of germanium and nitrogen and therefore has a nitrogen distribution like the intermediate layers 40 and 45 shown in FIGS. 3 and 6. More particularly, the nitrogen distribution is continuously decreased from the first surface to the second surface. The intermediate layer 51 also serves as a light absorbing layer for absorbing ambient light which is incident onto the transparent substrate 31 and which is directed towards the back electrode 33.

In the example being illustrated, an antireflection layer 52 is deposited on the front surface of the transparent substrate 31 by vacuum evaporation so as to reduce reflection of the ambient light incident on the front surface. The illustrated antireflection layer 52 may be a multilayer film which comprises a first film of aluminum oxide ($Al_2O_3$) on the front surface, a second film of tantalum pentoxide ($Ta_2O_5$) on the first film, and a third film of silicon oxide ($SiO_2$) on the second film. The first, the second, and the third films have optical thicknesses of $\lambda_0/4$, $\lambda_0/2$, and $\lambda_0/4$, respectively, where $\lambda_0$ represents a central wavelength of the visible range between 400 nm and 700 nm. The antireflection layer 52 may be of magnesium flouride ($MgF_2$).

The intermediate layer 51 is manufactured in the following manner. The intermediate layer 51 is deposited on the back dielectric layer 41 to a thickness of 1500 angstroms by reactive sputtering. The reactive sputtering is carried out in a sputtering device by the use of a target of germanium (Ge) in an atmosphere of a mixed gas kept at a pressure of $6\times10^{-1}$ Pascal. The mixed gas consists of nitrogen gas and argon gas. In this event, the target is supplied with a radio-frequency electric power of 6 W/cm$^2$ and the mixed gas is introduced into the sputtering device through a flow control equipment during the sputtering. During the sputtering, the ratio of the nitrogen gas to the mixed gas is continuously reduced from 70% to 30% by the flow control equipment and a deposition rate of the intermediate layer 51 is continuously increased from 100 angstroms/minute to 125 angstroms/minute. As a result, the resistivity of the intermediate layer 51 is continuously reduced from about $10^7\Omega\cdot$cm to about $10^4\Omega\cdot$cm. Thus, there is provided the intermediate layer 51 having a nitrogen distribution which is continuously decreased from the first surface to the second surface.

On the intermediate layer 51, the back electrode is formed as in the panel illustrated in FIG. 3 except that an alkaline solution of, for example, potassium hydroxide (KOH) is utilized as the etching solvent to etch the aluminum layer into the back electrode 33. This is because the intermediate layer 51 is not covered with the dielectric layer 42 which has an acid resistivity against the nitric acid.

Description is made about merits of the electroluminescent panel according to the third embodiment of this invention.

As is apparent from FIG. 5, the intermediate layer 51 has a refractive index $n_{51}$ continuously increased between 2.6 and 3.5 from the first surface to the second surface and an extinction coefficient $k_{51}$ continuously increased between 0.1 and 0.6 from the first surface to the second surface when the amount ratio of the nitrogen gas to the mixed gas is varied during the sputtering as described above. As a result, a reflectance in an interface between the back dielectric layer 41 ($n_{41}=2.2$) and the intermediate layer 51 is less than that of the panels illustrated in FIGS. 3 and 6. In addition, the intermediate layer 51 has a refractive index $n_{51}$ which continuously varies. Therefore, no reflection occurs within the intermediate layer 51 while the reflection occurs in an interface between the first and the second films 46 and 47 of the panel illustrated in FIG. 6. It is therefore possible to obtain a contrast higher than the panel illustrated in FIG. 6. Furthermore, the antireflection layer 52 can almost prevent reflection of the ambient light incident on the front surface of the transparent substrate 31. As a result, the electroluminescent panel illustrated in FIG. 7 exhibits a comparatively low reflectance characteristic as exemplified by a curve 53 in FIG. 4. An average reflectance is reduced to a range between 3% and 4% within the visible range of light.

The electroluminescent panel illustrated in FIG. 7 has a brightness versus applied voltage characteristic as exemplified by a curve 54 in FIG. 2. As is apparent from the curve 54, the brightness is steeply raised up with an increase of the applied voltage like in the panels illustrated in FIGS. 3 and 6. Furthermore, crosstalk can be avoided because the resistivity of the intermediate layer 51 is not less than $10^3\Omega\cdot$cm, as mentioned before. In order to avoid the crosstalk, the intermediate layer 51 may have a resistivity which is not less than about $10^3\Omega\cdot$cm.

Figure 8:
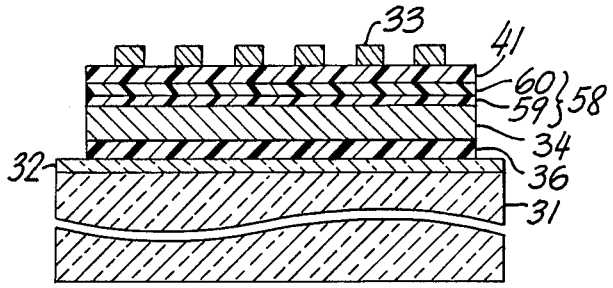
FIG. 8 is a sectional view of an electroluminescent panel according to a fourth embodiment of this invention.

Referring to FIG. 8, an electroluminescent panel according to a fourth embodiment of this invention comprises similar parts designated by like reference numerals. The electroluminescent panel comprises an intermediate layer 58 which is interposed between the electroluminescent layer 34 and the first or back dielectric layer 41. The intermediate layer 58 has first and second surfaces directed towards the electroluminescent layer 34 and the back electrode 33, respectively, and is divided into first and second films 59 and 60 which provide the first and the second surfaces, respectively. The first film 59 is in contact with the electroluminescent layer 34 on the first surface and with the second film 60 on an upper surface opposite to the first surface. The second film 60 is attached to the back dielectric layer 41 on the second surface.

Each of the first and the second films 59 and 60 consists of germanium and nitrogen. More specifically, each of the first and the second films 59 and 60 is of germanium nitride. The first and the second films 59 and 60 have first and second nitrogen distributions, respectively, each of which is substantially uniform. The first and the second nitrogen distributions are defined by first and second ratios of the nitrogen to the germanium, respectively. In the illustrated example, the second ratio is less than the first amount ratio. The intermediate layer 58 which is composed of the first and the second films 59 and 60 serves as a light absorbing layer similar to that illustrated in conjunction with FIGS. 3 and 6.

On manufacturing the intermediate layer 58, the first film 59 is first deposited on the electroluminescent layer 34 to a thickness of 1000 angstroms at a deposition rate of 80 angstroms/minute by reactive sputtering. The reactive sputtering is carried out in a sputtering device by using a germanium target in an atmosphere of a gas kept at a pressure of $6\times10^{-1}$ Pascal which consists of 100% of nitrogen gas. In this event, the target is supplied with a radio-frequency electric power of 6 W/cm$^2$. Since the gas is kept constant during the sputtering, the first nitrogen distribution becomes substantially uniform.

The first film 59 deposited in the above-mentioned manner has the resistivity of $10^9\Omega\cdot$cm and that first amount ratio of the nitrogen to the germanium which is dependent on the gas.

Subsequently, the second film 60 is deposited on the first film 59 to a thickness of 1500 angstroms at a deposition rate of 120 angstroms/minute by reactive sputtering. The reactive sputtering is carried out in the same sputtering device by the use of the target of germanium in an atmosphere of a mixed gas kept at a pressure of $6\times10^{-1}$ Pascal. The mixed gas consists of 40% of nitrogen gas and 60% of argon gas. In this event, the target is supplied with radio-frequency electric power of 6 W/cm$^2$. The second film 60 has a second nitrogen distribution which is substantially uniform, a resistivity of $10^5\Omega\cdot$cm, and a second ratio of nitrogen to germanium which is dependent on the mixed gas introduced. The second ratio is less than the first ratio of the first film 59. This is because the amount of the nitrogen gas in the atmosphere for the second film 60 is less than that for the first film 59.

Thus, the intermediate layer 58 has a nitrogen distribution decreased from the first surface towards the second surface. More particularly, the nitrogen distribution is stepwise decreased from the first surface to the second surface. On the second surface of the second film 60, the back dielectric layer 41 is formed as in the panel illustrated in FIG. 3. The back electrode 33 is formed on the dielectric layer 41.

With this structure, the illustrated electroluminescent panel is luminous in yellowish orange color to emit electroluminescent light when the a.c. voltage is supplied to the electroluminescent panel. The electroluminescent light has a peak wavelength of 580 nanometers.

Description is made about merits of the electroluminescent panel according to the fourth embodiment of this invention.

As is apparent from FIG. 5, the first film 59 has a refractive index $n_{59}$ equal to 2.6 and an extinction coefficient $k_{59}$ equal to 0.1 while the second film 60 has a refractive index $n_{60}$ equal to 3.0 and an extinction coefficient $k_{60}$ equal to 0.3. The illustrated electroluminescent layer 34 has a refractive index $n_{34}$ equal to 2.3.

As in FIG. 3, consideration is made about a reflectance in an interface between the electroluminescent layer 34 and the first film 59. The reflectance is represented by $R_{34.59}$ in relation to the electroluminescent layer 34 and the first film 59. The reflectance $R_{34.59}$ is given by:

$$R_{34.59}=[(n_{34}-n_{59})^2+k_{59}^2]/[(n_{34}+n_{59})^2+k_{59}^2]. \quad (4)$$

Taking the above-exemplified values into account, the reflectance $R_{34.59}$ becomes about 0.4%.

Likewise, a reflectance $R_{59.60}$ is considered in an interface between the first and the second films 59 and 60. The reflectance $R_{59.60}$ is approximately given by:

$$R_{59.60}\approx[(n_{59}-n_{60})^2+k_{60}^2]/[(n_{59}+n_{60})^2+k_{60}^2]. \quad (5)$$

With reference to the above-mentioned values, the reflectance $R_{59.60}$ becomes about 0.8%.

Thus, both reflectances $R_{34.59}$ and $R_{59.60}$ are extremely low. In addition, the intermediate layer 58 exhibits an extinction coefficient distribution stepwise increased from the first surface to the second surface because the extinction coefficient $k_{60}$ is larger than the extinction coefficient $k_{59}$. The intermediate or light absorbing layer 58 can therefore absorb the ambient light effectively even when it has a comparatively small thickness. As a result, the electroluminescent panel illustrated in FIG. 8 exhibits a low reflectance characteristic.

Figure 9:
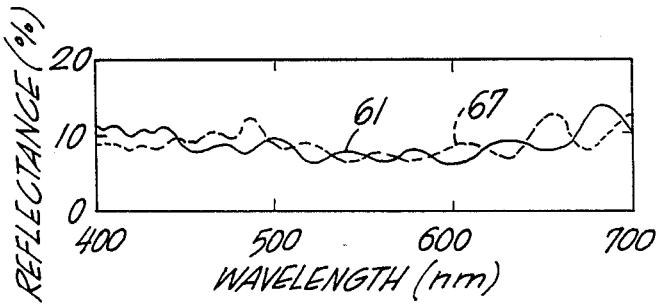
FIG. 9 is a graph for use in describing a reflectance of electroluminescent panels illustrated in FIGS. 8 and 11.

Referring to FIG. 9, the electroluminescent panel illustrated in FIG. 8 has the reflectance characteristic as exemplified by a curve 61. The reflectance is measured on an outside of the front surface of the transparent electrode 32. An average reflectance falls within a range between 7% and 8% within a visible range of light between 400 nm and 700 nm. Thus, such a low reflectance brings about a high contrast electroluminescent panel.

Figure 10:
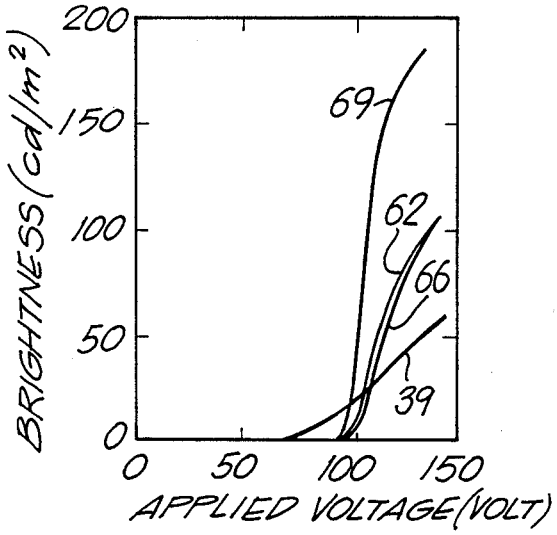
FIG. 10 is a graphical representation for use in describing brightness versus applied voltage characteristics of electroluminescent panels illustrated in FIGS. 1, 8, 11, and 12.

Referring to FIG. 10, the electroluminescent panel of FIG. 8 has a brightness versus applied voltage characteristic as exemplified by a curve 62. As is apparent from the curve 62, the brightness is steeply increased with increase of applied voltage between the transparent and the back electrodes 32 and 33. The brightness of 100 cd/m$^2$ is accomplished by supply of the applied voltage lower than 150 volts. Thus, the applied voltage can be reduced with the electroluminescent panel illustrated in FIG. 8. This makes it possible to avoid the dielectric breakdown. In FIG. 10, the brightness versus applied voltage characteristic of the conventional electroluminescent panel (FIG. 1) is illustrated for reference purpose by the curve 39 identical with that illustrated in FIG. 2.

Inasmuch as the first and the second films 59 and 60 have thicknesses of 1000 angstroms and 1500 angstroms which are effective to absorb the light, respectively, and resistivities of $10^9\Omega\cdot$cm and $10^5\Omega\cdot$cm, respectively, crosstalk can favorably be avoided.

The ratio of nitrogen is continuously varied in one of the first and the second films 59 and 60 while it is uniformly kept in the other one of the first and the second films 59 and 60.

In the panel illustrated in FIG. 8, the electroluminescent layer 34 is covered with the intermediate layer 58 of germanium nitride. It has been found out that the intermediate layer 58 strongly withstands the nitric acid in comparison with cadmium telluride (CdTe) used in the conventional electroluminescent panel. Furthermore, the intermediate layer 58 is covered with the back dielectric layer 41. This structure makes it possible to avoid peeling off or detachment of the back dielectric layer 41 from the electroluminescent layer 34 and occurrence of cracks of the back dielectric layer 41, while the aluminum layer is being etched to form the back electrode 33 by the use of the etching solvent of nitric acid. Strong adhesion of the back dielectric layer 41 to the electroluminescent layer 34 can be achieved by interposition of the intermediate layer 58, if the intermediate layer 58 has a thickness not less than 10 angstroms. It has been confirmed that the thickness of the intermediate layer 58 is restricted to a range equal to or thinner than 5000Å by the reason why an increase of the thickness brings about a tendency of an increase of a luminous threshold value and by the reason imposed on a production process.

Figure 11:
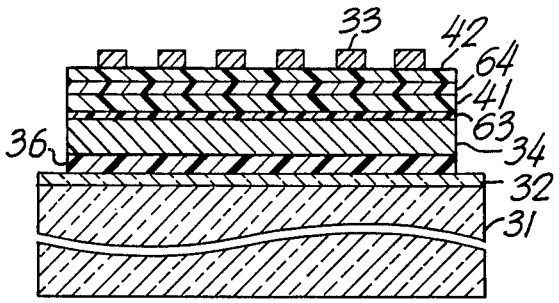
FIG. 11 is a sectional view of an electroluminescent panel according to a fifth embodiment of this invention.

Referring to FIG. 11, an electroluminescent panel according to a fifth embodiment of this invention comprises similar parts designated by like reference numerals. In FIG. 11, an intermediate layer has first and second films 63 and 64 and is interposed between the electroluminescent layer 34 and the back electrode 33. The first dielectric layer 41 is interposed between the first and the second films 63 and 64 and is in contact with the first and the second films 63 and 64. The first film 63 provides a first surface directed towards the electroluminescent layer 34 while the second film 64 provides a second surface directed towards the back electrode 33. The first film 63 is in contact with the electroluminescent layer 34 on the first surface while the second film 64 is in contact with the second dielectric layer 42 at the second surface.

Each of the first and second films 63 and 64 consists of germanium and nitrogen, namely, germanium nitride. As in FIGS. 6 and 8, the first and the second films 63 and 64 serve to absorb ambient light and will collectively be called a light absorbing layer. The first and second films 63 and 64 have first and second nitrogen distributions, respectively, each of which is substantially uniform. The first and the second nitrogen distributions are defined by first and second amount ratios of the nitrogen to the germanium, respectively. The second amount ratio is less than the first amount ratio.

The first film 63 is deposited on the electroluminescent layer 34 at a deposition rate of 80 angstroms/minute to a thickness of 300 angstroms by reactive sputtering like the first film 59 illustrated in FIG. 8. In this event, the reactive sputtering is carried out by the use of a target of germanium in an atmosphere of that gas kept at a pressure of $6\times10^{-1}$ Pascal which consists of 100% of nitrogen gas. Therefore, the first film 63 has the first nitrogen distribution which is substantially uniform. The first film 63 has a resistivity of $10^9\Omega\cdot$cm.

Subsequently, the first dielectric layer 41 is deposited on the first film 63 as in the panel in FIG. 3.

On the first dielectric layer 41, the second film 64 is deposited to a thickness of 2500 angstroms at a deposition rate of 115 angstroms/minute by reactive sputtering like the first film 63. In this event, the reactive sputtering is carried out by the use of the target of germanium in an atmosphere of that mixing gas kept at a pressure of $6\times10^{-1}$ Pascal which consists of 45% of nitrogen gas and 55% of argon gas. The mixing gas is kept unchanged during deposition of the second film 64. Therefore, the second nitrogen distribution is also substantially uniform in the second film 64. The second film 64 has a second ratio of the nitrogen to the germanium which is lower than the first ratio because the amount of the nitrogen gas in the atmosphere for the second film 64 is less than that of the first film 63. As a result, the second film 64 has a resistivity of $10^6\Omega\cdot$cm.

The second dielectric layer 42 is formed on the second film 64.

On etching the aluminum layer into the back electrode 33, it is possible to prevent the first dielectric layer 41 from being detached from the electroluminescent layer 34 and to avoid occurrence of cracks in the first dielectric layer 41 by interposition of the first film 63 between the electroluminescent and the first dielectric layers 34 and 41 like in the panel illustrated in FIG. 8.

The electroluminescent panel exhibits an excellent brightness versus applied voltage characteristic as exemplified by a curve 66 in FIG. 10 like in the panel illustrated in FIG. 8.

Inasmuch as each of the first and the second films 63 and 64 has a high resistivity greater than $10^3\Omega\cdot$cm, crosstalk scarcely occurs in the electroluminescent panel illustrated in FIG. 11.

Furthermore, the electroluminescent panel (FIG. 11) has a low reflectance characteristic as exemplified by a curve 67 (FIG. 9) like the panel illustrated in FIG. 8 and therefore exhibits a high contrast.

In the electroluminescent panel (FIG. 11), at least one of the first and the second nitrogen distribution may be continuously decreased from the first surface to the second surface. Alternatively, at least one of the first and the second nitrogen distribution may be stepwise decreased from the first surface to the second surface.

Figure 12:
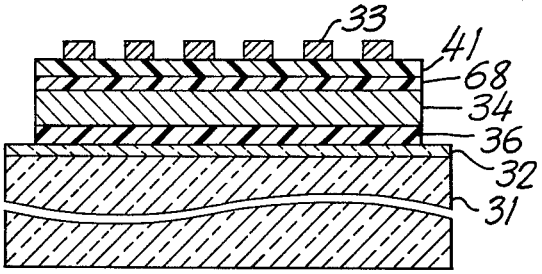
FIG. 12 is a sectional view of an electroluminescent panel according to a sixth embodiment of this invention.

Referring to FIG. 12, an electroluminescent panel according to a sixth embodiment of this invention comprises similar parts designated by like reference numerals. The electroluminescent panel comprises an intermediate layer 68 which is interposed between the electroluminescent layer 34 and the first or back dielectric layer 41. The intermediate layer 68 has first and second surfaces directed towards the electroluminescent layer 34 and the back electrode 33, respectively. The first and the second surfaces are in contact with the electroluminescent and the back dielectric layers 34 and 41, respectively.

The intermediate layer 68 consists of germanium and nitrogen, namely, germanium nitride. The intermediate layer 68 has substantially uniform nitrogen distribution. The intermediate layer 68 serves as a light absorbing layer for absorbing external light which is incident onto the transparent substrate 31 and which is directed towards the back electrode 33.

The intermediate layer 68 is manufactured in the following manner. The intermediate layer 68 is deposited on the electroluminescent layer 34 at a deposition rate of 80 angstroms/minute to a thickness of 100 angstroms by reactive sputtering like the first film 59 illustrated in FIG. 8. The reactive sputtering is carried out in a sputtering device by the use of a target of germanium (Ge) in an atmosphere of that gas kept at a pressure of $6\times10^{-1}$ Pascal which consists of 100% of nitrogen gas. Inasmuch as the amount of the nitrogen gas included in the atmosphere is constant during the reactive sputtering, the intermediate layer 68 has a substantially uniform nitrogen distribution. The intermediate layer 68 has a resistivity of $10^9\Omega\cdot$cm. The second surface of the intermediate layer 68 is covered with the back dielectric layer 41.

With this structure, the illustrated panel is luminous in yellowish orange color to emit electroluminescent light when the a.c. voltage is supplied between the transparent and the back electrodes 32 and 33.

Description will now be made about merits of the electroluminescent panel according to the sixth embodiment of this invention. In the panel, the electroluminescent layer 34 is covered with the intermediate layer 68 which strongly withstands the nitric acid in comparison with a layer of cadmium telluride (CdTe). In addition, the intermediate layer 68 is covered with the back dielectric layer 41.

With this structure, peeling off or detachment of the back dielectric layer 41 and occurrence of cracks can be avoided on etching the aluminum layer in a manner similar to that described in conjunction with the other embodiments. Strong adhesion of the back dielectric layer 41 to the electroluminescent layer 34 can be achieved by interposition of the intermediate layer 68, when the intermediate layer 68 has a thickness which is not less than 10 angstroms. In FIG. 12 also, the thickness may be restricted to a range equal to or less than 5000Å, as mentioned before.

The electroluminescent panel of FIG. 12 has a brightness versus applied voltage characteristic as exemplified by a curve 69 in FIG. 10. As is seen from the curve 69, the brightness is steeply raised up with an increase of the applied voltage between the transparent and the back electrodes because the intermediate layer 68 has a large resistivity of $10^9\Omega\cdot$cm. As a result, the brightness of 150 cd/m$^2$ is readily achieved by applying a low a.c. voltage of a sinusoidal wave of 100 Hz to the electroluminescent panel.

Temporarily referring to FIG. 5, the intermediate layer 68 (FIG. 12) has a refractive index $n_{68}$ equal to 2.6 and an extinction coefficient $k_{68}$ equal to 0.1 in dependency upon the atmosphere in which the intermediate layer 68 is formed. The illustrated electroluminescent layer 34 has a refractive index $n_{34}$ equal to 2.3. The illustrated back dielectric layer 41 has a refractive index $n_{41}$ equal to 2.2. Under the circumstances, reflectances $R_{34.68}$ and $R_{68.41}$ are defined in an interface between the electroluminescent layer 34 and the intermediate layer 68 and in another interface between the intermediate layer 68 and the back dielectric layer 41. The reflectances $R_{34.68}$ and $R_{68.41}$ can be calculated in a manner similar to the other reflectances mentioned before and become about 0.4% and 0.7%, respectively. Both the reflectances $R_{34.68}$ and $R_{68.41}$ are negligible because they are considerably small in comparison with a reflectance of the back electrode 33 which falls within a range between 50% and 60%. Thus, a high contrast can be accomplished by the electroluminescent panel illustrated in FIG. 12 also.

Figure 13:
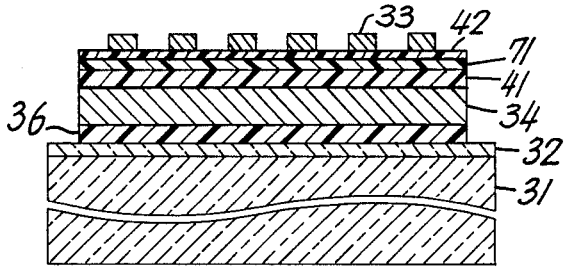
FIG. 13 is a sectional view of an electroluminescent panel according to a seventh embodiment of this invention.

Referring to FIG. 13, an electroluminescent panel according to a seventh embodiment of this invention comprises an intermediate layer 71 interposed between the first and the second dielectric layers 41 and 42. The intermediate layer 71 provides first and second surfaces which are directed towards the electroluminescent layer 34 and the back electrode 33, respectively, and which are in contact with the first and the second dielectric layers 41 and 42, respectively.

It is to be noted here that the intermediate layer 71 essentially consists of germanium, nitrogen, and oxygen i.e. germanium oxynitride and serves as a light absorbing layer. The intermediate layer 71 has a substantially uniform distribution of the nitrogen and a substantially uniform distribution of the oxygen.

On manufacturing the intermediate layer 71, deposition is carried out after deposition of the first dielectric layer 41 at a deposition rate of 120 angstroms/minute by reactive sputtering. The intermediate layer 71 is deposited to a thickness of 2000 angstroms. The reactive sputtering is carried out by the use of a target of germanium (Ge) in an atmosphere of that mixed gas kept at a pressure of $6\times10^{-1}$ Pascal which consists of 30% of nitrogen gas, 3% of oxygen gas, and 67% of argon gas. In this event, the target is supplied with a radio-frequency electric power of 6 W/cm$^2$. Inasmuch as the amount of the nitrogen gas and the oxygen gas included in the atmosphere is kept constant during the reactive sputtering, the intermediate layer 71 has a substantially uniform nitrogen distribution and a substantially uniform oxygen distribution. The intermediate layer 71 has a resistivity of $10^5\Omega\cdot$cm. The intermediate layer 71 is covered with the second dielectric layer 42.

The illustrated panel is luminous in yellowish orange color to emit electroluminescent light when the a.c. voltage is supplied between the transparent and the back electrodes 32 and 33. The electroluminescent light has a peak wavelength of 580 nm.

Figure 14:
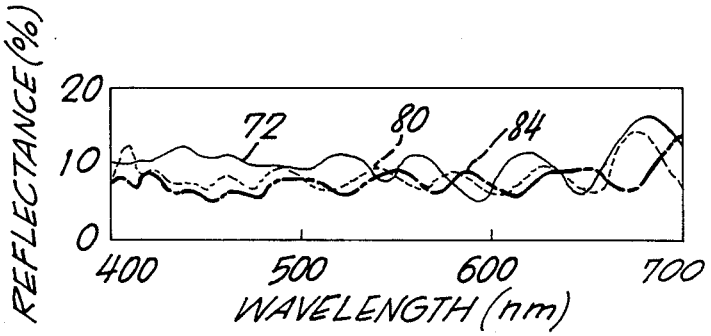
FIG. 14 is a graph for use in describing a reflectance of electroluminescent panels illustrated in FIGS. 13, 18, and 19.

Referring to FIG. 14, the electroluminescent panel (FIG. 13) exhibits a reflectance characteristic as exemplified by a curve 72. An average reflectance is reduced to about 9%. The electroluminescent panel therefore has a high contrast.

Figure 15:
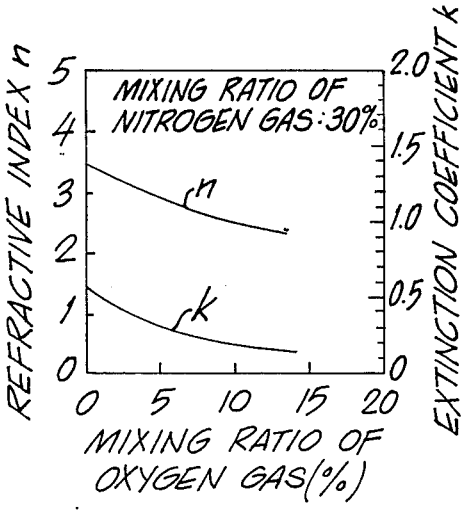
FIG. 15 is a graphical representation for use in describing a method of manufacturing intermediate layers of electroluminescent panels of this invention.

Referring to FIG. 15, the intermediate layer (that is, the light absorbing layer) 71 has optical constants specified by a refractive index n and an extinction coefficient k. Both the refractive index n and the extinction coefficient k of the intermediate layer 71 (FIG. 13) are variable in dependency upon a first mixing ratio of the oxygen gas to the mixed gas when a second mixing ratio of the nitrogen gas to the mixed gas is kept at 30%.

As mentioned before, the refractive index n and the extinction coefficient k are measured for light of a wavelength of 600 nm outside of the transparent substrate 31.

Figure 16:
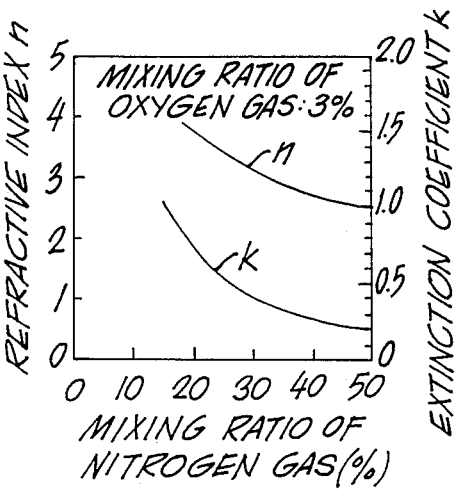
FIG. 16 is a graphical representation for use in describing a method of manufacturing intermediate layers of electroluminescent panels of this invention.

Referring to FIG. 16, the optical constants of the intermediate layer 71 (FIG. 13) are also variable in dependency upon the second mixing ratio of the nitrogen gas to the mixed gas when the first mixing ratio of the oxygen gas to the mixed gas is kept at 3%.

As shown in FIGS. 15 and 16, the refractive index $n_{71}$ and the extinction coefficient $k_{71}$ of the illustrated light absorbing layer 71 are equal to 3.2 and 0.4, respectively, for the light of wavelength of 600 nm. Furthermore, the first dielectric layer 41 has a refractive index $n_{41}$ equal to 2.2 for the light of wavelength of 600 nm. The reflectance $R_{41.71}$ can be defined in the above-mentioned manner in an interface between the first dielectric and the light absorbing layers 41 and 71 and can be calculated like in the Equation (1). The resultant reflectance $R_{41.71}$ becomes about 4.0%.

Figure 17:
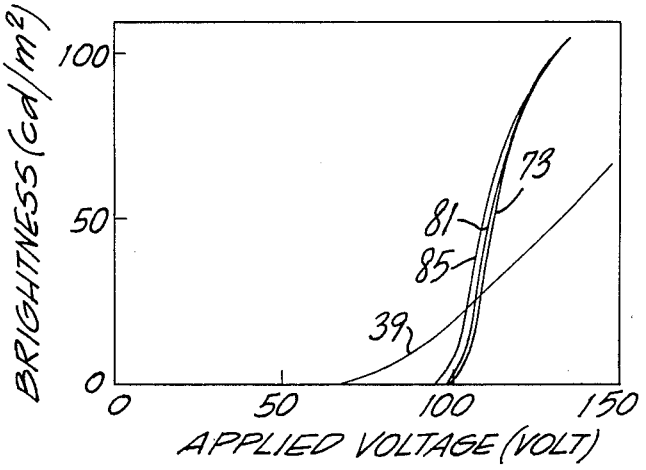
FIG. 17 is a graphical representation for use in describing brightness versus applied voltage characteristics of electroluminescent panels illustrated in FIGS. 1, 13, 18, and 19.

Referring to FIG. 17, the electroluminescent panel (FIG. 13) has a brightness versus applied voltage characteristic as exemplified by a curve 73. As is apparent from the curve 73, the brightness is steeply raised up with an increase of the applied voltage. It is possible to lower the applied voltage necessary for the brightness of 100 cd/m$^2$. The electroluminescent panel has advantages similar to those of the panels according to the other embodiments.

Figure 18:
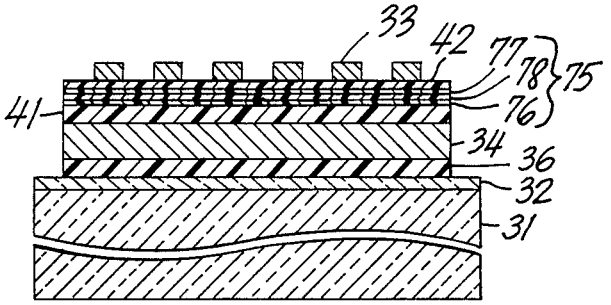
FIG. 18 is a sectional view of an electroluminescent panel according to an eighth embodiment of this invention.

Referring to FIG. 18, an electroluminescent panel according to an eighth embodiment of this invention comprises an intermediate layer 75 providing first and second surfaces which are directed towards the electroluminescent layer 34 and the back electrode 33, respectively. The intermediate layer 75 has first, second, and third films 76, 77, and 78. The first and the second films 76 and 77 have the first and the second surface, respectively, while the third film 78 is intermediate between the first and the second films 76 and 77 and is in contact with the first and second films 76 and 77. The first film 76 is in contact with the first dielectric layer 41 on the first surface. The second film 77 is in contact with the second dielectric layer 42 on the second surface.

Each of the first and the third films 76 and 78 consists of germanium, nitrogen, and oxygen, like the intermediate layer 71 illustrated in FIG. 13.

On manufacturing the intermediate layer 75, the first film 76 is at first deposited on the first dielectric layer 41 at a deposition rate of 110 angstroms/minute to a thickness of 300 angstroms by reactive sputtering. The reactive sputtering is carried out in a manner similar to that described in conjunction with FIG. 13 except that a mixed gas consists of 30% of nitrogen gas, 10% of oxygen gas, and 60% of argon gas. The mixed gas is kept unchanged during the reactive sputtering. The first film 76 has a substantially uniform nitrogen distribution of the nitrogen and a substantially uniform oxygen distribution of the oxygen, and exhibits a resistivity of $10^6\Omega\cdot$cm.

Subsequently, the third film 78 is deposited on the first film 76 at a deposition rate of 125 angstroms/minute to a thickness of 1000 angstroms by reactive sputtering like the first surface 76. In this event, the mixed gas is somewhat modified into an additional mixed gas. The additional mixed gas consists of 30% of nitrogen gas, 3% of oxygen gas, and 67% of argon gas and is kept invariable during the reactive sputtering for the third film 78. The third film 78 therefore has a substantially uniform nitrogen distribution and a substantially uniform oxygen distribution. The third film 78 thus manufactured has a resistivity of $10^5\Omega\cdot$cm.

On the third film 78, the second film 77 is deposited at a deposition rate of 125 angstroms/minute to a thickness of 500 angstroms by reactive sputtering. This reactive sputtering is carried out in an atmosphere of a subsidiary mixed gas which consists of 30% of nitrogen gas and 70% of argon gas. No oxygen gas is included in the subsidiary mixed gas. The second film 77 therefore has a substantially uniform nitrogen distribution and a resistivity of $10^4\Omega\cdot$cm.

The intermediate layer 75 collectively has a sheet resistance of $4.5\times10^9\Omega/\square$.

Thus, the intermediate layer 75 has a substantially uniform nitrogen distribution and an oxygen distribution which is stepwise decreased from the first surface to the second surface. The resistivity of the intermediate layer 75 is gradually decreased from the first film 76 towards the second film 77.

Subsequently, the second dielectric layer 42 overlies the second film 77 in the manner mentioned before.

The illustrated electroluminescent panel is luminous like in the panel illustrated in FIG. 13.

In FIG. 14, the reflectance characteristic of the electroluminescent panel illustrated in FIG. 18 is shown by a curve 80 and is lower than that of the electroluminescent panel illustrated in FIG. 13. An average reflectance becomes about 8% within a visible range of light between 400 nm and 700 nm. It is therefore possible to provide a high contrast electroluminescent panel.

Consideration will now be made about the reason why such a low reflectance is obtained. The first dielectric layer 41 has a refractive index $n_{41}$ of 2.2. As is apparent from FIG. 15, the first film 76 has a refractive index $n_{76}$ of 2.6 and an extinction coefficient $k_{76}$ of 0.2.

Under the circumstances, it is possible to calculate a reflectance $R_{41.76}$ in an interface between the first dielectric layer 41 and the first film 76 in the above-mentioned manner. The resultant reflectance $R_{41.76}$ becomes about 0.9%.

On the other hand, the refractive index $n_{78}$ and the extinction coefficient $k_{78}$ of the third film 78 are equal to 3.2 and 0.4, respectively. A reflectance $R_{76.78}$ in an interface between the first and the third films 76 and 78 can be calculated in the above-mentioned manner and becomes about 1.5%.

Furthermore, the refractive index $n_{77}$ and the extinction coefficient $k_{77}$ of the second film 77 are equal to 3.5 and 0.6, respectively. A reflectance $R_{78.77}$ can also be calculated in relation to an interface between the third and the second films 78 and 77 like $R_{76.78}$ and becomes about 1.0%.

In addition, the intermediate layer 78 has an extinction coefficient distribution which is stepwise increased from the first surface to the second surface because $k_{76}=0.2$, $k_{78}=0.4$, and $k_{77}=0.6$. As a result, ambient light which is incident on the first film 76 and which is directed towards the back electrode 33 is increasingly absorbed by the first, the third, and the second film 76, 78, and 77. Accordingly, the ambient light can be almost perfectly extinct in the intermediate layer 75.

In FIG. 17, the brightness versus applied voltage characteristic of the electroluminescent panel (FIG. 18) is also shown by a curve 81 and similar to that of the electroluminescent panels according to the other embodiments of this invention. Therefore, the electroluminescent panel (FIG. 18) is excellent in the brightness versus applied voltage characteristic in comparison with the conventional electroluminescent panel.

In the electroluminescent panel illustrated in FIG. 18, the nitrogen distribution may also be stepwise decreased from the first surface to the second surface.

Figure 19:
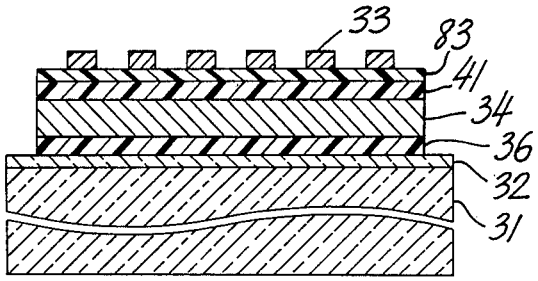
FIG. 19 is a sectional view of an electroluminescent panel according to a ninth embodiment of this invention.

Referring to FIG. 19, an electroluminescent panel according to a ninth embodiment of this invention comprises, as a light absorbing layer, an intermediate layer 83 interposed between the back dielectric layer 41 and the back electrode 33. The intermediate layer 83 has first and second surfaces directed towards the electroluminescent layer 34 and the back electrode 33, respectively. The intermediate layer 83 is in contact with the back dielectric layer 41 and the back electrode 33 on the first and the second surfaces, respectively.

Briefly, the intermediate layer 83 essentially consists of germanium, nitrogen, and oxygen and has a nitrogen distribution of the nitrogen decreased from the first surface towards the second surface. More specifically, the nitrogen distribution is continuously decreased from the first surface to the second surface. In addition, an oxygen distribution is substantially uniform in the intermediate layer 83.

The intermediate layer 83 is manufactured by reactive sputtering after deposition of the back dielectric layer 41. The reactive sputtering is carried out in a manner similar to that mentioned before by the use of a mixed gas of nitrogen gas, oxygen gas, and argon gas. During the sputtering, a first mixing ratio of the oxygen gas to the mixed gas is kept at 3%. On the other hand, a second mixing ratio of the nitrogen gas to the mixed gas is continuously reduced from 50% to 25% by a flow control equipment as the sputtering proceeds.

Under the circumstances, a deposition rate of the intermediate layer 83 is continuously increased from 100 angstroms/minute to 125 angstroms/minute. As a result, a resistivity of the intermediate layer 83 is continuously reduced from about $10^7\Omega\cdot$cm to about $10^4\Omega\cdot$cm. Thus, the intermediate layer 83 has a nitrogen distribution which is continuously decreased from the first surface to the second surface.

On the intermediate layer 83, the back electrode 33 is formed like in the panel illustrated in FIG. 7.

As is shown in FIG. 16, the intermediate layer 83 has a refractive index $n_{83}$ continuously increased between 2.5 and 3.5 from the first surface to the second surface and an extinction coefficient $k_{83}$ continuously increased between 0.2 and 0.6 from the first surface to the second surface when the second mixing ratio of the nitrogen gas to the mixed gas is varied during the sputtering as described above. As a result, a reflectance in an interface between the back dielectric layer 41 ($n_{41}=2.2$) and the intermediate layer 83 is lower than the reflectances of the panels illustrated in FIGS. 13 and 18. In addition, the intermediate layer 83 has a refractive index $n_{83}$ which continuously varies. Therefore, no reflection occurs within the intermediate layer 83 while the reflection occurs in interfaces between the first and the third films 76 and 78 and between the third and the second films 78 and 77 of the panel illustrated in FIG. 18. It is therefore possible to obtain a contrast higher than the panel illustrated in FIG. 18. Furthermore, the electroluminescent panel illustrated in FIG. 19 exhibits a comparatively low reflectance characteristic as exemplified by a curve 84 in FIG. 14. An average reflectance is reduced to about 6% within the visible light range.

The electroluminescent panel illustrated in FIG. 19 has a brightness versus applied voltage characteristic as exemplified by a curve 85 in FIG. 17. As is apparent from the curve 85, the brightness is steeply increased with an increase of the applied voltage like in the panel illustrated in FIGS. 13 and 18. Furthermore, crosstalk can be avoided because resistivity of the intermediate layer 83 is not less than $10^3\Omega\cdot$cm.

In the electroluminescent panel illustrated in FIG. 19, the nitrogen distribution may be stepwise decreased from the first surface to the second surface. In this case, the oxygen distribution may be continuously or stepwise decreased from the first surface to the second surface.

In the electroluminescent panel illustrated in FIG. 19, the nitrogen distribution may be a substantially uniform distribution. In this case, the oxygen distribution may be continuously or stepwise decreased from the first surface to the second surface.

While this invention has thus far been described in conjunction with several preferred embodiments thereof, it will now readily be possible for those skilled in the art to put this invention into practice in various other manners. For example, it is desirable that each of the intermediate or light absorbing layers 40, 45, 51, 58, 64, 68, 71, 75, and 83 is restricted to a thickness between 500 angstroms and 5000 angstroms in consideration of an optical constant thereof, a resistivity thereof, and manufacturing processes thereof. On manufacturing the intermediate layers by the use of reactive sputtering, other inert gas, such as neon gas, krypton gas, or xenon gas, may be used instead of argon gas. The intermediate layers may be formed by the use of a selected one of reactive evaporation, ion plating, chemical vapor deposition techniques. Each of the front, the back or first, and the second dielectric layers may be of an oxide selected from a group of aluminum oxide ($Al_2O_3$), strontium titanate ($SrTiO_3$), barium tantalate ($BaTa_2O_6$), yttrium oxide ($Y_2O_3$), and hafnium oxide ($HfO_2$). Each of the front, the back or first, and the second dielectric layers may also be of silicon nitride ($Si_3N_4$) or silicon-oxynitride. The transparent electrode 32 may be of an oxide selected from a group of indium oxide ($In_2O_3$), indium oxide ($In_2O_3$) doped with tungsten (W), tin oxide ($SnO_2$), and tin oxide ($SnO_2$) doped with either antimony (Sb) or fluorine (F). As regards the electroluminescent layer 34, the base material may be selected from a group of zinc selenide (ZnSe), calcium sulfide (CaS), strontium sulfide (SrS), and the like. The activator may be a rare-earth element selected from a group of europium (Eu), samarium (Sm), terbium (Tb), thurium (Tm), and the like. The back electrode 33 may be of a metal selected from a group of tantalum (Ta), molybdenum (Mo), iron (Fe), nickel (Ni), nickel aluminum (NiAl), nickel chromium (NiCr), and the like. The transparent and the back electrodes 32 and 33 may be formed by dry etching technique in a gas of carbon tetrachlorine ($CCl_4$) and by a selective evaporation technique using a mask. Finally, the transparent substrate 31 may be, for example, of soda-lime glass, quartz, or the like.

What is claimed is:

1. An electroluminescent panel comprising a transparent electrode, a back electrode opposite said transparent electrode, and an electroluminescent layer for emitting electroluminescent light between said transparent and said back electrodes, said electroluminescent panel further comprising: an intermediate layer between said electroluminescent layer and said back electrode, said intermediate layer consisting of germanium and nitrogen to form germanium nitride whereby said intermediate layer provides the electroluminescent panel with a high rate of brightness increase for an applied voltage.

2. An electroluminescent panel as claimed in claim 1, wherein said intermediate layer has a substantially uniform nitrogen distribution therein.

3. An electroluminescent panel as claimed in claim 1, said intermediate layer having a first surface directed towards said electroluminescent layer and a second surface directed towards said back electrode, wherein said intermediate layer has a nitrogen distribution which decreases from said first surface towards said second surface.

4. An electroluminescent panel as claimed in claim 3, wherein said nitrogen distribution is continuously decreased from said first surface to said second surface.

5. An electroluminescent panel as claimed in claim 3, wherein said nitrogen distribution is stepwise decreased from said first surface to said second surface.

6. An electroluminescent panel as claimed in claim 1, further comprising a dielectric layer between said electroluminescent and said intermediate layers, said dielectric layer being in contact with said electroluminescent and said intermediate layers.

7. An electroluminescent panel as claimed in claim 6, wherein said intermediate layer is in contact with said back electrode.

8. An electroluminescent panel as claimed in claim 1, further comprising a first dielectric layer between said electroluminescent and said intermediate layers and a second dielectric layer between said intermediate layer and said back electrode, said first dielectric layer being in contact with said electroluminescent and said intermediate layers, said second dielectric layer being in contact with said intermediate layer and said back electrode.

9. An electroluminescent panel as claimed in claim 1, said intermediate layer having a first surface directed towards said electroluminescent layer and a second surface directed towards said back electrode, wherein said first surface is in contact with said electroluminescent layer.

10. An electroluminescent panel as claimed in claim 9, further comprising a dielectric layer between said intermediate layer and said back electrode, said dielectric layer being in contact with said second surface.

11. An electroluminescent panel as claimed in claim 10, wherein said intermediate layer has a substantially uniform nitrogen distribution of said nitrogen.

12. An electroluminescent panel as claimed in claim 10, wherein said intermediate layer has a nitrogen distribution which decreases from said first surface towards said second surface.

13. An electroluminescent panel as claimed in claim 12, wherein said nitrogen distribution is continuously decreased from said first surface to said second surface.

14. An electroluminescent panel as claimed in claim 12, wherein said nitrogen distribution is stepwise decreased from said first surface to said second surface.

15. An electroluminescent panel as claimed in claim 9, wherein said intermediate layer has a first and a second film which provide said first and said second surfaces, respectively.

16. An electroluminescent panel as claimed in claim 15, further comprising a dielectric layer between said first and said second films, said dielectric layer being in contact with said first and said second films.

17. An electroluminescent panel as claimed in claim 16, wherein said first and said second films have a first and a second nitrogen distribution of said nitrogen, respectively, each of said first and said second nitrogen distributions being substantially uniform.

18. An electroluminescent panel as claimed in claim 17, wherein said first and said second films have a first and a second ratio of said nitrogen to said germanium, respectively, said second ratio being less than said first ratio.

19. An electroluminescent panel as claimed in claim 16, wherein said first film has a first nitrogen distribution of said nitrogen decreased from said first surface towards said second surface, said second film having a second nitrogen distribution of said nitrogen increased from said second surface towards said first surface.

20. An electroluminescent panel as claimed in claim 19, wherein said first nitrogen distribution is continuously decreased from said first surface towards said second surface, said second nitrogen distribution being continuously increased from said second surface towards said first surface.

21. An electroluminescent panel as claimed in claim 19, wherein said first nitrogen distribution is continuously decreased from said first surface towards said second surface, said second nitrogen distribution being stepwise increased from said second surface towards said first surface.

22. An electroluminescent panel as claimed in claim 19, wherein said first nitrogen distribution is stepwise decreased from said first surface towards said second surface, said second nitrogen distribution being continuously increased from said second surface towards said first surface.

23. An electroluminescent panel as claimed in claim 19, wherein said first nitrogen distribution is stepwise decreased from said first surface towards said second surface, said second nitrogen distribution being stepwise increased from said second surface towards said first surface.

24. An electroluminescent panel comprising a transparent electrode, a back electrode opposite said transparent electrode, and an electroluminescent layer for emitting electroluminescent light between said transparent and said back electrodes, said electroluminescent panel further comprising: an intermediate layer between said electroluminescent layer and said back electrode, said intermediate layer consisting of germanium, nitrogen, and oxygen to form germanium oxynitride whereby said intermediate layer provides the electroluminescent panel with a high rate of brightness increase for an applied voltage.

25. An electroluminescent panel as claimed in claim 24, wherein said intermediate layer has a substantially uniform nitrogen distribution of said nitrogen.

26. An electroluminescent panel as claimed in claim 24, said intermediate layer having a first surface directed towards said electroluminescent layer and a second surface directed towards said back electrode, wherein said intermediate layer has a nitrogen distribution of said nitrogen decreased from said first surface towards said second surface.

27. An electroluminescent panel as claimed in claim 26, wherein said nitrogen distribution is continuously decreased from said first surface to said second surface.

28. An electroluminescent panel as claimed in claim 26, wherein said nitrogen distribution is stepwise decreased from said first surface to said second surface.

29. An electroluminescent panel as claimed in claim 24, wherein said intermediate layer has a substantially uniform oxygen distribution of said oxygen.

30. An electroluminescent panel as claimed in claim 29, wherein said intermediate layer has a substantially uniform nitrogen distribution of said nitrogen.

31. An electroluminescent panel as claimed in claim 29, said intermediate layer having a first surface directed towards said electroluminescent layer and a second surface directed towards said back electrode, wherein said intermediate layer has a nitrogen distribution of said nitrogen decreased from said first surface towards said second surface.

32. An electroluminescent panel as claimed in claim 31, wherein said nitrogen distribution is continuously decreased from said first surface to said second surface.

33. An electroluminescent panel as claimed in claim 31, wherein said nitrogen distribution is stepwise decreased from said first surface to said second surface.

34. An electroluminescent panel as claimed in claim 24, said intermediate layer having a first surface directed towards said electroluminescent layer and a second surface directed towards said back electrode, wherein said intermediate layer has an oxygen distribution of said oxygen decreased from said first surface towards said second surface.

35. An electroluminescent panel as claimed in claim 34, wherein said intermediate layer has a substantially uniform nitrogen distribution of said nitrogen.

36. An electroluminescent panel as claimed in claim 34, wherein said intermediate layer has a nitrogen distribution of said nitrogen decreased from said first surface towards said second surface.

37. An electroluminescent panel as claimed in claim 36, wherein said nitrogen distribution is continuously decreased from said first surface to said second surface.

38. An electroluminescent panel as claimed in claim 36, wherein said nitrogen distribution is stepwise decreased from said first surface to said second surface.

39. An electroluminescent panel as claimed in claim 34, wherein said oxygen distribution is continuously decreased from said first surface to said second surface.

40. An electroluminescent panel as claimed in claim 39, wherein said intermediate layer has a substantially uniform nitrogen distribution of said nitrogen.

41. An electroluminescent panel as claimed in claim 39, wherein said intermediate layer has a nitrogen distribution of said nitrogen decreased from said first surface towards said second surface.

42. An electroluminescent panel as claimed in claim 41, wherein said nitrogen distribution is continuously decreased from said first surface to said second surface.

43. An electroluminescent panel as claimed in claim 41, wherein said nitrogen distribution is stepwise decreased from said first surface to said second surface.

44. An electroluminescent panel as claimed in claim 34, wherein said oxygen distribution is stepwise decreased from said first surface to said second surface.

45. An electroluminescent panel as claimed in claim 44, wherein said intermediate layer has a substantially uniform nitrogen distribution of said nitrogen.

46. An electroluminescent panel as claimed in claim 44, wherein said intermediate layer has a nitrogen distribution of said nitrogen decreased from said first surface towards said second surface.

47. An electroluminescent panel as claimed in claim 46, wherein said nitrogen distribution is continuously decreased from said first surface to said second surface.

48. An electroluminescent panel as claimed in claim 46, wherein said nitrogen distribution is stepwise decreased from said first surface to said second surface.

49. An electroluminescent panel as claimed in claim 24, further comprising a dielectric layer between said electroluminescent and said intermediate layers, said dielectric layer being in contact with said electroluminescent and said intermediate layers.

50. An electroluminescent panel as claimed in claim 49, wherein said intermediate layer is in contact with said back electrode.

51. An electroluminescent panel as claimed in claim 24, further comprising a first dielectric layer between said electroluminescent and said intermediate layers and a second dielectric layer between said intermediate layer and said back electrode, said first dielectric layer being in contact with said electroluminescent and said intermediate layers, said second dielectric layer being in contact with said intermediate layer and said back electrode.

* * * * *